United States Patent [19]

Hutchinson

[11] Patent Number: 4,799,914

[45] Date of Patent: Jan. 24, 1989

[54] REMOTE CONTROL LIGHTER-THAN-AIR TOY WITH TETHER

[76] Inventor: Jack M. Hutchinson, 504 Corinth, Bay, St. Louis, Miss. 39520

[21] Appl. No.: 12,314

[22] Filed: Feb. 9, 1987

[51] Int. Cl.[4] ..... A63H 3/06; B64B 1/02

[52] U.S. Cl. ..... 446/225; 446/33; 446/220; 446/90; 244/30; 244/96

[58] Field of Search ..... 446/30, 31, 33, 220, 446/224, 225, 901, 488; 244/26, 30, 33, 96

[56] References Cited

U.S. PATENT DOCUMENTS

| | | | |
|---|---|---|---|
| 1,657,955 | 1/1928 | Bylek | 244/26 |
| 1,718,349 | 6/1929 | Gordon | 446/488 |
| 2,192,300 | 3/1940 | Droitcour | 244/26 |
| 2,885,206 | 5/1959 | Ensley | 446/31 |
| 3,108,396 | 10/1963 | Dorman | 446/901 |
| 3,292,304 | 12/1966 | Wolfe | 446/225 |
| 3,464,153 | 9/1969 | Small | 446/901 |
| 4,085,912 | 4/1978 | Slater | 244/30 |
| 4,125,223 | 11/1978 | Winker et al. | 446/225 |
| 4,145,838 | 3/1979 | Mason | 446/220 |
| 4,204,656 | 5/1980 | Seward | 244/31 |
| 4,366,936 | 1/1983 | Ferguson | 244/30 |
| 4,573,937 | 3/1986 | Stanzel | 446/31 |
| 4,591,125 | 5/1986 | Piasecki et al. | 244/26 |
| 4,729,750 | 3/1988 | Prusman | 446/225 |

FOREIGN PATENT DOCUMENTS

| | | | |
|---|---|---|---|
| 658406 | 2/1963 | Canada | 446/31 |
| 220431 | 3/1910 | Fed. Rep. of Germany . | |
| 2619155 | 11/1977 | Fed. Rep. of Germany | 244/96 |
| 2397976 | 3/1979 | France | 244/26 |
| 2043467 | 10/1980 | United Kingdom | 446/31 |

OTHER PUBLICATIONS

Ragner, Maurice G.; American Modeler, Apr. 1961, pp. 14, 15, 46.

*Primary Examiner*—Robert A. Hafer
*Assistant Examiner*—Charles H. Harris
*Attorney, Agent, or Firm*—William M. Hobby

[57] ABSTRACT

A remote control lighter-than-air toy apparatus has an inflatable container having a predetermined shape, such as the shape of a dirigible, for holding a lighter-than-air gas. A gondola is removably attached to the inflatable container and has a shaft extending therethrough and rotably supported thereon. A reversible electric motor is attached to each end portion of the shaft passing through the gondola with each electric motor having a propeller attached thereto for rotation upon actuation of the electric motor. Each of the electric motors and propellers are fixedly attached to the shaft. A tether line is formed of a plurality of conductors, each connected at one end to one of the electric motors and connected at the other end to a control box having a plurality of controls thereon for remotely controlling each motor separately, so that a lighter than air toy can be remotely controlled with two propellers.

4 Claims, 1 Drawing Sheet

REMOTE CONTROL LIGHTER-THAN-AIR TOY WITH TETHER

BACKGROUND OF THE INVENTION

The present invention relates to toys and especially to lighter-than-air toys having motorized propellers attached thereto and remotely controlled with a tether line.

In the past, there has been wide use of dirigibles, which are lighter-than-air aircraft, that are filed with lighter-than-air gasses, such as helium. A typical dirigible has a bullet shape with a gondola attached of the bottom with motor driven propellers for controlling the movement of the dirigible. It has also been suggested in the past to fill balloons and other containers with lighter-thangas air. Sometimes these are on tether lines for preventing their loss. Other lighter-than-air toys can be seen in the Goldfarb Patent, U.S. Pat. No. 3,225,488 and in the Winker Patent, U.S. Pat. No. 4,125,233 which Patents show toy blimps tethered from the ground. The Wolfe Patent U.S. Pat. No. 3,292,304 shows a toy spaceship filled with a lighter-than-air gas and having three separate electrically driven propellers for controlling the toy in several directions from a console on the ground. The Propellers are driven by reversible electric motors.

In contrast to these prior patents, the present invention has a blimp shape similar to the prior dirigibles and dirigible looking toys and is remotely controlled, but provides two propellers which, in addition to being forward and reversably driven, can be rotated on the shaft attached to the gondola. The gondola can be removably attached to a lighter-than-air container for a rapid changing of the gondola from one lighter-than-air container to another.

SUMMARY OF THE INVENTION

The present invention relates to a remote control lighter-than-air toy having an inflatable container having a predetermined shape for holding a lighter-than-air gas. A gondola is removably attached to the inflatable container, such as with hook and loop material on one side of the gondola and on the flexible container, or alternatively, with an adhesive that allows the gondola to be removed. A shaft extends through the gondola and is rotably supported thereon in sleeves mounted thereto. A reversible electric motor is attached to each end portion of each shaft and has a propeller attached thereto for rotation upon actuation of the electric motor. Each of the electric motors and propellers are ratably attached to the shaft for adjusting the position of the propeller for gaining additional control. A third electric motor may be mounted in the gondola for remote control of the rotation of the shaft. A tether line is formed of a plurality of flexible conductor wires with each wire connected to the gondola at one end and through the gondola to each electric motor. A control box has a plurality of controls thereon and is connected to the other end of the electric wires so that the electric wires are acting as a tether line and allow the remote control box to control the movement of the tethered inflatable container.

BRIEF DESCRIPTION OF THE DRAWINGS

Other objects, features and advantages of the present invention will be apparent from the written description and the drawings in which.

DESCRIPTION OF THE PREFERRED EMBODIMENT

Figure 1:
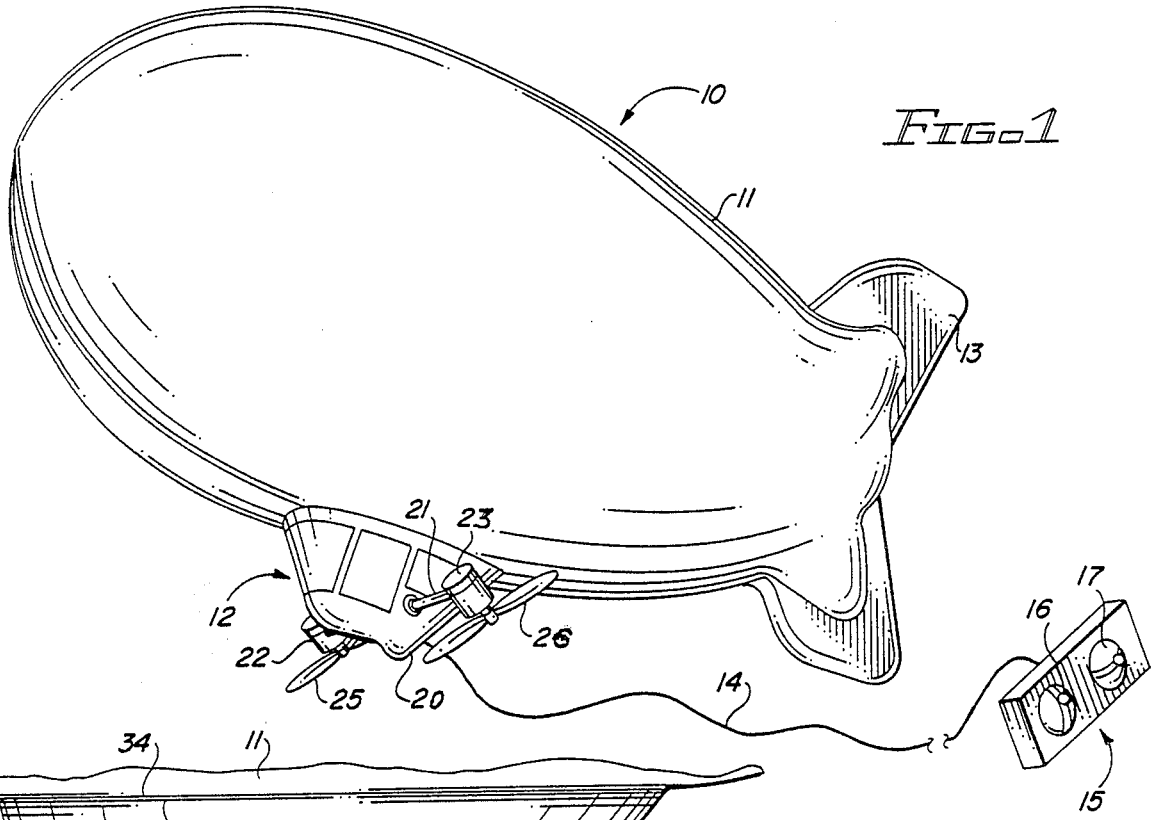
FIG. 1 is a perspective view of a remote controlled lighter-than-air toy.
Figure 2:
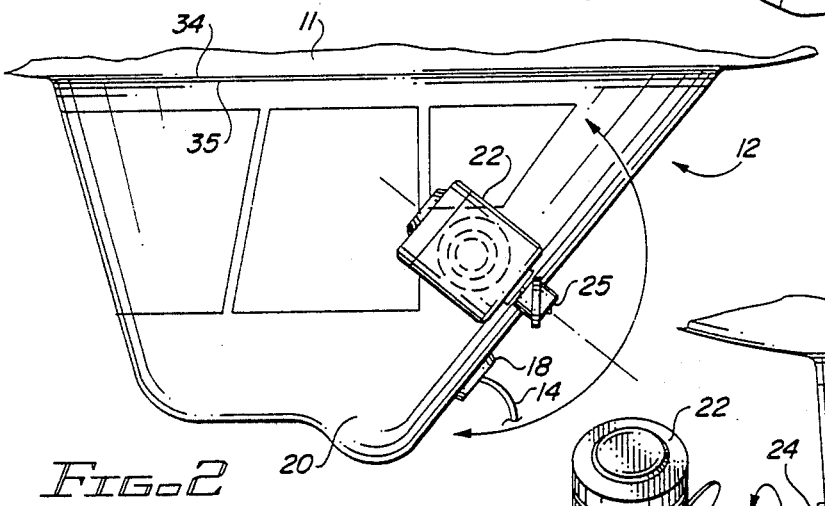
FIG. 2 is a side elevation of a gondola attached to the lighter-than-air toy of FIG. 1.
Figure 3:
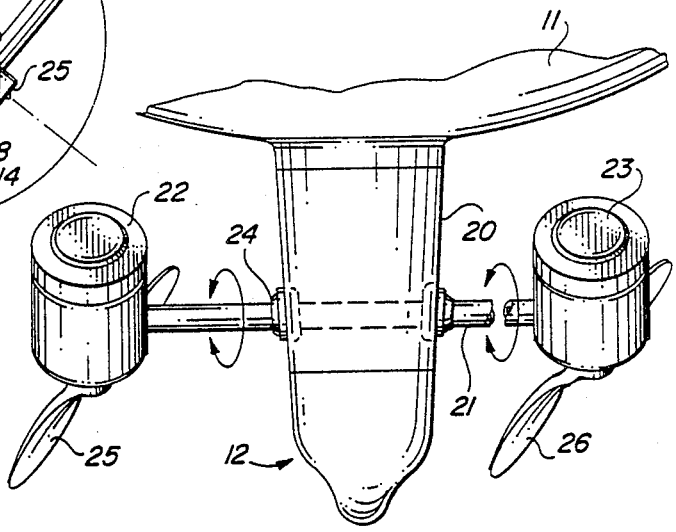
FIG. 3 is a front partial sectional view of a gondola in accordance with FIGS. 1 and 2.
Figure 4:
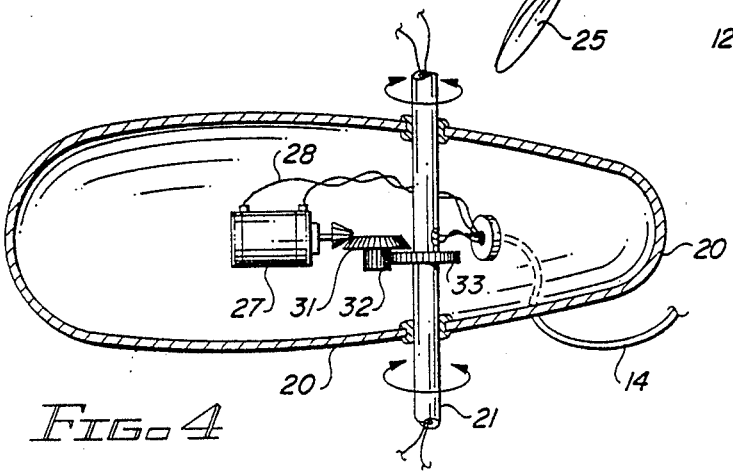
FIG. 4 is a sectional view taken through the gondola of FIGS. 1 through 3.

Referring to the drawings, a lighter-than-air toy 10 is illustrated having an inflatable bag or lighter-than-air container 11 shaped in this case like a dirigible but of greatly reduced size. The inflatable bag 11 can be made of a tin mylar polymer or other polymer as desired and has a gondola 12 placed on the bottom thereof. The shape of the bag 11 includes a pair of stabilizer fins 13. The gondola 12 has a tether line 14 made up of a plurality of conductors connected thereto and connected to a control box 15 at one end and to the gondola 12 at the other end. The control box has at least a pair of controls 16 and 17 positioned therein and may have batteries therein for controlling the flow of current through the conductors in the tether line 14. The control 16 and 17 may be electrical switches for switching the current on and off in a positive or negative direction or may be potentiometers for better control. The tether line 14 is connected with a grommet 18 to the gondola 12 for holding the gondola which extends into the gondola body 20 and into a shaft 21 in which a pair of wires runs to a first motor 22 on one end of the shaft 21 and to an electric motor 23 on the other end of the shaft 21. The shaft is mounted in a pair of sleeves 24 in the gondola body 20 and can be rotated thereon. Each motor 22 and 23 can also be rotated on the shaft 20 and may be pressure fitted for rotation thereon under sufficient torque, so that once positioned it will stay in that position unless sufficient torque is placed on it to rotate the motor. The motor 22 has a propeller 25 thereon while the motor 23 has a propeller 26 mounted to the shaft thereof. The motors 22 and 23 are electric reversible DC motors which can be made to rotate the propellers 25 and 26 in a forward or reversible direction by the direction of the DC current applied thereto.

Similarly, the shaft 21 can be rotated to rotate both motors 22 and 23 simultaneously within the pressure sleeves 24 and then will maintain the position by the pressure from the sleeves 24 which may be made of a rubber or other material having sufficient frictional qualities to hold the shaft in position. Alternatively, a third electric motor 27 may be mounted inside the gondola 12 and connected to conductors 28 forming a part of the tether line 14 for driving in a forward or reverse direction an electric motor shaft 30 which drives a gear 31 which in turn drives a gear 32 and a gear 33 mounted to the shaft 21 so that the rotation of the shaft 21 can be remotely controlled from the control box 15 to rotate in a forward or reverse direction, depending upon the direction of the current applied to the motor 27. Since batteries operate the control, positive or negative voltage can be applied to any particular wire with switches to actuate any particular motor in a forward or reversible direction. The gondola in this case, is supported with one portion of VELCRO are hook and pile material 34 attached to the inflatable bag 11, while the gondola has a section of VELCRO (hook and pile material) 35 attached thereto for attaching the gondola directly to the inflatable bag 11. This allows the entire gondola 12, tether line 14 and control panel 15 to be removed from the flexible container 11 and placed on a different shaped toy if desired, or alternatively to replace the inflatable bag 11 if it should become damaged. The inflatable container 11 is made of a thin mylar film which can become damaged if it becomes intangled against a sharp or pointed object. The inflatable container needs to be inflated prior to use since the helium used for inflating the toy tends to be lost over a period of time. A portable helium inflating tank of small size, which can be commercially purchased, is used for filling the containers before use.

It should be clear at this time that a remote controlled lighter-than-air toy has been provided but it should also be clear that the present invention is not limited to the forms shown which are to be considered illustrative rather than restrictive.

I claim:

1. A remote control lighter-than-air toy comprising:

an inflatable container having a predetermined shape for holding a lighter-than-air gas;

a gondola removably attached to said inflatable container, said gondola having a strip of hook and loop material attached thereto and said inflatable container having a strip of hook and loop material attached thereto for removably attaching said gondola to said inflatable container;

a shaft extending through said gondola and rotatably supported thereto;

a reversible electric motor attached to each end portion of said shaft, each electric motor having a propeller attached thereto for rotation upon actuation of the electric motor, each said electric motor and propeller being attached to said shaft;

a tether line formed of a plurality of flexible conductor wires, each wire connected at the distal end to one of said electric motors;

a control box having a plurality of controls thereon connected to the other end of each of said tether line electric wires for remotely controlling each said electric motor separately; whereby said lighter-than-air toy can be remotely controlled with two propellers; and a third electric motor mounted in said gondola and coupled to said shaft and connected through said tether line to said control box for rotating said shaft responsive to the application of power thereto.

2. A remote controlled lighter-than-air toy in accordance with claim 1 in which said third electric motor is a reversible motor for rotating said shaft in two directions.

3. A remote controlled lighter-than-air toy in accordance with claim 2 in which said gondola has a pair of sleeves mounted therein supporting said shaft therethrough.

4. A remote controlled lighter-than-air toy in accordance with claim 3 in which each said electric motor is rotably attached to one end of said shaft and is frictionally supported in position thereon.

* * * * *